US009372012B2

(12) United States Patent
Farris

(10) Patent No.: US 9,372,012 B2
(45) Date of Patent: Jun. 21, 2016

(54) DETERMINING HEATING ELEMENT AND WATER HEATER STATUS BASED ON GALVANIC CURRENT

(71) Applicant: General Electric Company, Schenectady, NY (US)

(72) Inventor: Brett Alan Farris, Louisville, KY (US)

(73) Assignee: General Electric Company, Schenectady, NY (US)

( * ) Notice: Subject to any disclaimer, the term of this patent is extended or adjusted under 35 U.S.C. 154(b) by 432 days.

(21) Appl. No.: 13/891,250

(22) Filed: May 10, 2013

(65) Prior Publication Data

US 2014/0334807 A1 Nov. 13, 2014

(51) Int. Cl.

| | |
|---|---|
| ***F24H 1/20*** | (2006.01) |
| ***H05B 3/78*** | (2006.01) |
| ***F24H 9/20*** | (2006.01) |
| ***H05B 1/02*** | (2006.01) |
| *F24H 1/18* | (2006.01) |
| *F24H 9/00* | (2006.01) |

(52) U.S. Cl.

CPC ..... *F24H 9/2021* (2013.01); *H05B 1/0269* (2013.01); *H05B 3/78* (2013.01); *F24H 1/185* (2013.01); *F24H 9/0047* (2013.01)

(58) Field of Classification Search

None

See application file for complete search history.

(56) References Cited

U.S. PATENT DOCUMENTS 2,486,871 A * 11/1949 Osterheld ..... C23F 13/02 204/196.11
2,740,757 A * 4/1956 Craver ..... C23F 13/02 204/196.11
2,982,714 A * 5/1961 Sabins ..... C23F 13/04 204/196.03
2,987,461 A * 6/1961 Sabins ..... C23F 13/04 204/196.02
3,049,479 A * 8/1962 Preiser ..... C23F 13/04 204/196.3
3,714,004 A * 1/1973 Riggs, Jr. ..... C23F 13/04 204/196.03
4,559,017 A * 12/1985 Cavil ..... C23F 13/02 204/196.3
4,713,158 A * 12/1987 Lambert ..... G01R 17/02 204/196.03
4,786,383 A * 11/1988 Houle ..... C23F 13/20 204/196.11
4,848,616 A * 7/1989 Nozaki ..... F24H 9/0047 204/196.11

(Continued)

FOREIGN PATENT DOCUMENTS

CN 101267102 9/2008

*Primary Examiner* — Thor Campbell
(74) *Attorney, Agent, or Firm* — Dority & Manning, P.A.

(57) ABSTRACT

Systems and methods for determining heating element and water heater status based on galvanic current are provided. An exemplary water heater includes a tank for holding a volume of water and an anode rod extending into the water. The anode rod has a core made of a conductive material. The water heater also includes at least one heating element configured to heat the water when energized. The water heater includes a current measurement circuit configured to generate a feedback signal describing a galvanic current flowing from the core of the anode rod to an electrical ground. The water heater also includes a controller configured to receive the feedback signal from the current measurement circuit and to control one or more operations of the water heater based on the feedback signal.

20 Claims, 7 Drawing Sheets

(56) References Cited

U.S. PATENT DOCUMENTS 5,256,267 A * 10/1993 Roden ..... C23F 13/10 122/13.01
5,335,311 A * 8/1994 Groothuizen ..... H05B 3/82 204/196.11
7,706,670 B2 4/2010 Knoeppel et al.
7,857,949 B2 * 12/2010 Closset ..... C23F 13/18 204/196.11
8,023,807 B2 * 9/2011 Knoeppel ..... C23F 13/02 392/441
8,068,727 B2 * 11/2011 Phillips ..... F24H 9/0047 392/441
8,162,232 B2 4/2012 Knoeppel et al.
8,608,913 B2 * 12/2013 Shim ..... C23F 13/04 204/196.1
2007/0210067 A1 * 9/2007 Patterson ..... F24H 9/2014 219/481
2010/0116812 A1 * 5/2010 Watson ..... F24H 1/202 219/481
2014/0218006 A1 * 8/2014 Gross ..... G01N 17/02 324/71.4

* cited by examiner

DETERMINING HEATING ELEMENT AND WATER HEATER STATUS BASED ON GALVANIC CURRENT

FIELD OF THE INVENTION

The present disclosure relates to a water heater. More particularly, the present disclosure relates to determining heating element and water heater status based on galvanic current.

BACKGROUND OF THE INVENTION

Most modern water heaters are constructed of a steel tank with a glass lining. Passive anode rods are a vital component to water heaters utilizing a steel tank or other forms of tanks susceptible to corrosion. An anode rod can act as a sacrificial anode that provides protection against tank corrosion. In particular, the anode rod acts as a sacrificial anode by way of galvanic corrosion.

As a result of the galvanic corrosion, a galvanic current can flow from the anode rod to a cathode to which the anode rod is electrically connected. The cathode is commonly the exterior of the tank connected to an earth ground. The anode rod is depleted by the galvanic corrosion and therefore acts as a sacrificial anode.

Water heaters also frequently include one or more heating elements positioned inside the tank and configured to heat water stored in the tank. For example, a heating element can provide heat by way of electrical resistance. The heating element can resist an electrical current and therefore generate heat, raising the temperature of the water.

It is important to the proper operation of a water heater that an energization status of each heating element included in the water heater be known or able to be determined. In particular, to properly heat the water to a desired temperature and avoid dangerous conditions such as scalding water, a water heater must be able to determine whether or not a heating element is currently energized.

One particularly dangerous condition which must be avoided is operation of a heating element in a "dry tank." More particularly, as discussed above, a heating element can be used to dissipate or provide a significant amount of heat. When the heating element is submerged in water, the water surrounding the heating element safely accepts or absorbs such heat.

However, when the water in the tank is depleted through use or otherwise reduced to a level where the heating element is no longer submerged, operation of the heating element can be dangerous. In particular, the heating element can overheat and catch fire, among other dangers.

Therefore, improved systems and methods for determining heating element and water heater status are desirable. In particular, improved systems and methods for determining heating element and water heater status which leverage the presence of a galvanic current are desirable.

BRIEF DESCRIPTION OF THE INVENTION

Aspects and advantages of the invention will be set forth in part in the following description, or may be obvious from the description, or may be learned through practice of the invention.

One aspect of the present disclosure is directed to a water heater. The water heater includes a tank for holding a volume of water and an anode rod extending into the water. The water heater also includes at least one heating element configured to heat the water when energized. The water heater includes a current measurement circuit configured to generate a feedback signal describing a galvanic current flowing from the anode rod to an electrical ground. The water heater also includes a controller configured to receive the feedback signal from the current measurement circuit and to control one or more operations of the water heater based on the feedback signal.

Another aspect of the present disclosure is directed to a method of operating a water heater. The method includes receiving a feedback signal describing a galvanic current flowing from an anode rod included in the water heater to an electrical ground. The method includes energizing a first heating element. The first heating element is configured to heat a volume of water stored in the water heater when energized. The method includes monitoring, based on the feedback signal, for an increase in galvanic current when the first heating element is energized.

Another aspect of the present disclosure is directed to a method of operating a water heater having a first heating element and a second heating element. The method includes monitoring a galvanic current flowing from an anode rod positioned inside the water heater to an electrical ground. The method includes determining an energization status of each of the first heating element and the second heating element by comparing the galvanic current to a plurality of galvanic current profiles. The plurality of galvanic current profiles include a first galvanic current profile describing the behavior of the galvanic current when the neither the first heating element nor the second heating element are energized. The plurality of galvanic current profiles include a second galvanic current profile describing the behavior of the galvanic current when the first heating element is energized and the second heating element is not energized. The plurality of galvanic current profiles include a third galvanic current profile describing the behavior of the galvanic current when the second heating element is energized and the first heating element is not energized. The plurality of galvanic current profiles include a fourth galvanic current profile describing the behavior of the galvanic current when both the first heating element and the second heating element are energized.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
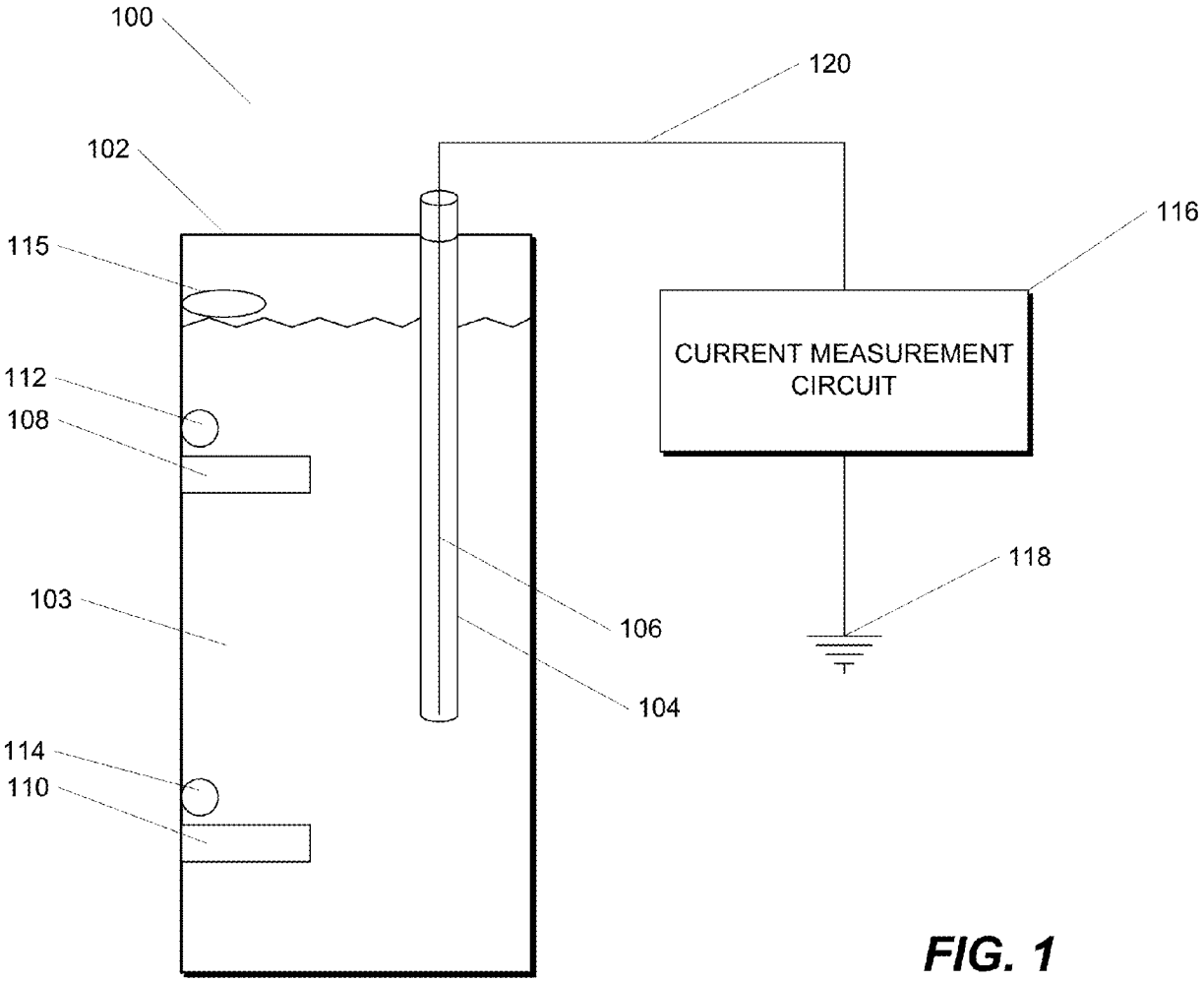
FIG. 1 depicts an exemplary water heating system according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally the present disclosure is directed to systems and methods for determining heating element and water heater status based on galvanic current. In particular, according to the present disclosure, detectable changes in galvanic current characteristics can be used to determine whether one or more heating elements are submerged and operating. As such, a water heater can include a current measurement circuit that generates a feedback signal describing the galvanic current. Further, a controller can control one or more operations of the water heater based on the feedback signal.

An anode rod is a commonly included component in modern water heaters. The anode rod can act as a sacrificial anode which protects the interior of a tank from corrosion by suffering galvanic corrosion in place of the tank. In particular, the anode rod can have a more negative electrochemical potential than the tank to be protected and therefore act as the anode in a galvanic reaction.

A galvanic current can be generated due to the corrosion of the anode rod. The galvanic current can flow from the anode rod to an electrical ground which is electrically connected to the anode rod. Often such electrical ground is the exterior of the tank connected to an earth ground. As used herein, the term "galvanic current" refers generally to the current flowing from the anode to the electrical ground, whether such current is entirely the result of galvanic corrosion or includes current generated by other environmental factors.

According to an aspect of the present disclosure, the galvanic current flowing from the anode rod to the electrical ground can be monitored for detectable changes. In particular, when a water heater heating element is energized or otherwise enabled, a significant increase in galvanic current occurs. Such increase in galvanic current can be due to the heat produced by the element and/or leakage current from the heating element.

A current measurement circuit can be placed between the anode rod and the electrical ground. The current measurement circuit can generate a feedback signal that describes one or more characteristics of the galvanic current. As an example, the current measurement circuit can amplify a voltage across a shunt resistor in the path of galvanic current flow.

A controller of the water heater can control one or more operations of the water heater based on the feedback signal. As an example, the controller can control energization of one or more of the heating elements included in the water heater based on the feedback signal. For example, the controller can alter the heating element between energization states such as off and on.

As another example, the controller can receive additional signals or information from other components of the water heater, such as, for example, a temperature sensor, a current transformer, or a water level sensor. The controller can operate the water heater based on the feedback signal and one or more of the additional signals.

FIG. 1 depicts an exemplary water heating system 100 according to an exemplary embodiment of the present disclosure. Water heating system 100 can include tank 102 that holds a volume of water 103. An anode rod 104 can pass through an opening at the top of tank 102 and extend downwards into water 103. For example, anode rod 104 can be mounted to tank 102 at the opening where anode rod 104 enters tank 102. Anode rod 104 can be isolated from direct electrical connection to tank 102 by means of a insulated cap or liner placed between anode rod 104 and tank 102 at the place of mounting.

Figure 2:
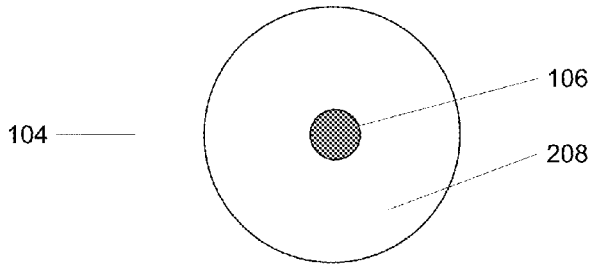
FIG. 2 depicts a cross-sectional view of an exemplary anode rod according to an exemplary embodiment of the present disclosure.

With reference to FIG. 2, a cross-sectional view of an exemplary anode rod 104 according to an exemplary embodiment of the present disclosure is depicted. Anode rod 104 can have a core 106 and an outer region 208. Core 106 can extend coaxially with outer region 208 throughout anode rod 104 such that core region 106 is coaxially surrounded by outer region 208. Other suitable configurations can be used to satisfy the present disclosure in addition to the configuration shown in FIG. 2.

Outer region 208 can be made of any suitable material. For example, outer region 208 can be made of magnesium, aluminum, or an aluminum-zinc alloy. Core 106 can be made of any conductive material. As an example, core 106 can be a conductive wire, such as, for example, a steel wire.

Returning to FIG. 1, water heating system 100 can further include a first heating element 108 and a second heating element 110. First and second heating elements 108 and 110 can be attached to an interior of tank 102. For example, heating elements 108 and 110 can be disposed at different heights within tank 102.

Heating elements 108 and 110 can be configured to heat water 103 when energized. As an example, heating elements 108 can 110 can be resistance heating elements which generate heat by resisting an electric current. However, heating elements 108 and 110 can each be any suitable device, structure, or circuit for generating heat to raise the temperature of water 103.

Water heating system 100 can further include temperature sensors 112 and 114. Temperature sensors 112 and 114 can be positioned inside the tank proximate to heating elements 108 and 110. In particular, temperature sensor 112 can be positioned proximate to heating element 108 while temperature sensor 114 can be positioned proximate to 110.

Temperature sensors 112 and 114 can respectively provide a temperature signal describing a temperature in their respective local regions. For example, temperature sensor 112 can provide a temperature signal describing an ambient temperature about sensor 112. As an example, temperature sensors 112 and 114 can be thermistors.

Water heater system 100 can further include a water level sensor 115. Water level sensor 115 can detect when the water 103 in tank 102 has reached a particular level. Water level sensor 115 can be any suitable device for detecting the presence of water 103.

According to an aspect of the present disclosure, anode rod 104 can act as a sacrificial anode to protect the interior of tank 102 from corrosion. In particular, anode rod 104 can suffer galvanic corrosion in place of tank 102. Such galvanic corrosion can generate a galvanic current flowing from anode rod 104 to an electrical ground 118. Electrical ground 118 can be the exterior of the tank 102 which is connected to an earth ground.

The galvanic current can flow from anode rod 104 to electrical ground 118 by way of electrical conductor 120. For example, electrical conductor 120 can be connected to core 106 of anode rod 104. Electrical conductor 120 can be made of any suitable conductive material and can include one or more wires, filters, or other suitable components.

Electrical conductor 120 can allow flow of the galvanic current from anode rod 104 to a current measurement circuit 116. Current measurement circuit 116 can measure or otherwise monitor the galvanic current flowing from anode rod 104 to electrical ground 118. Current measurement circuit 116 can generate a feedback signal describing the galvanic current. For example, the feedback signal can describe a general amplitude of the galvanic current. As another example, the feedback signal can be processed or otherwise used to calculate a general amplitude of the galvanic current.

One of skill in the art will appreciate that many components of water heating system 100 have been omitted from FIG. 1 in order to simplify the system for illustration and presentation. For example, water heating system 100 can include a water inlet pipe, a water exit pipe, a dip tube, one or more valves, a flow meter, a mixer, power source components, or any other suitable components necessary or desirable for water heater operation.

Figure 3:
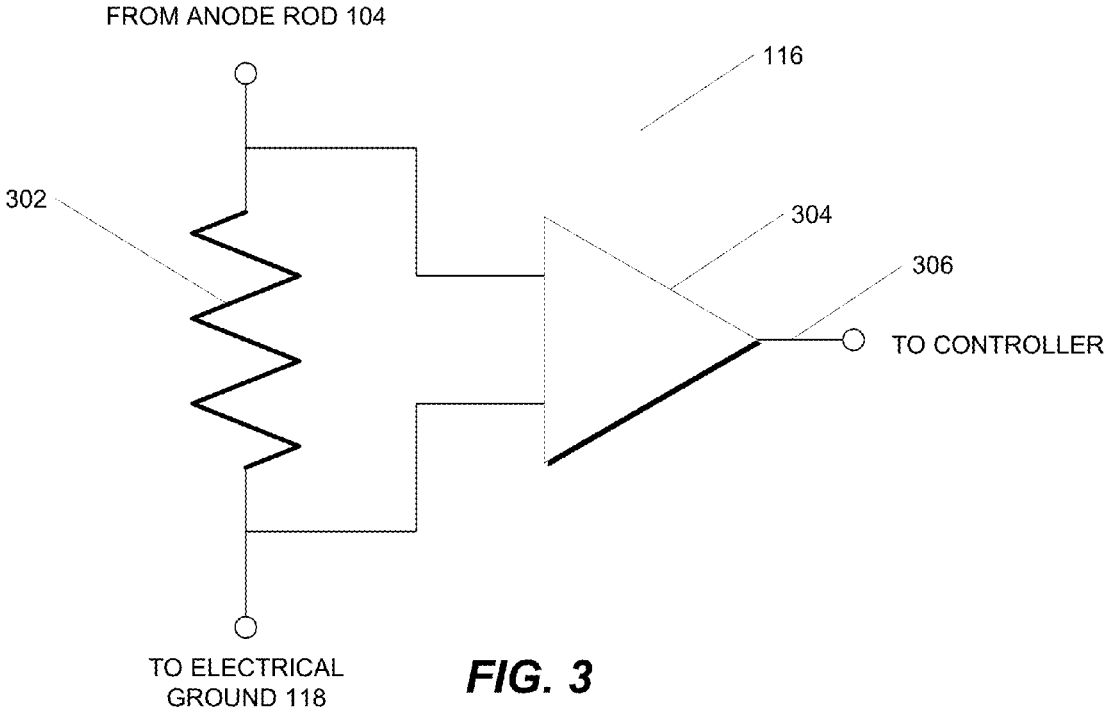
FIG. 3 depicts an exemplary current measurement circuit according to an exemplary embodiment of the present disclosure.

FIG. 3 depicts an exemplary current measurement circuit 116 according to an exemplary embodiment of the present disclosure. Current measurement circuit can include a shunt resistor 302 and an operational amplifier 304.

Shunt resistor 302 can be positioned in the path of galvanic current flow from anode rod 104 to electrical ground 118. Shunt resistor 302 can provide any suitable magnitude of resistance. Generally, however, the resistance provided by shunt resistor 302 should be very small in order to minimize the resistive effect of shunt resistor 302 on galvanic current flow.

Operational amplifier 304 can be a differential operational amplifier that amplifies the voltage across shunt resistor 302. Operational amplifier 304 can be a discrete circuit or a high accuracy integrated circuit that includes precise resistors to minimize variation. The output of operational amplifier 304 can be a feedback signal 306. Feedback signal 306 can optionally be filtered or processed prior to being delivered to the water heater controller. In such fashion, one or more characteristics or attributes of the galvanic current flowing from anode rod 104 to electrical ground 118 can be measured or monitored.

Figure 4:
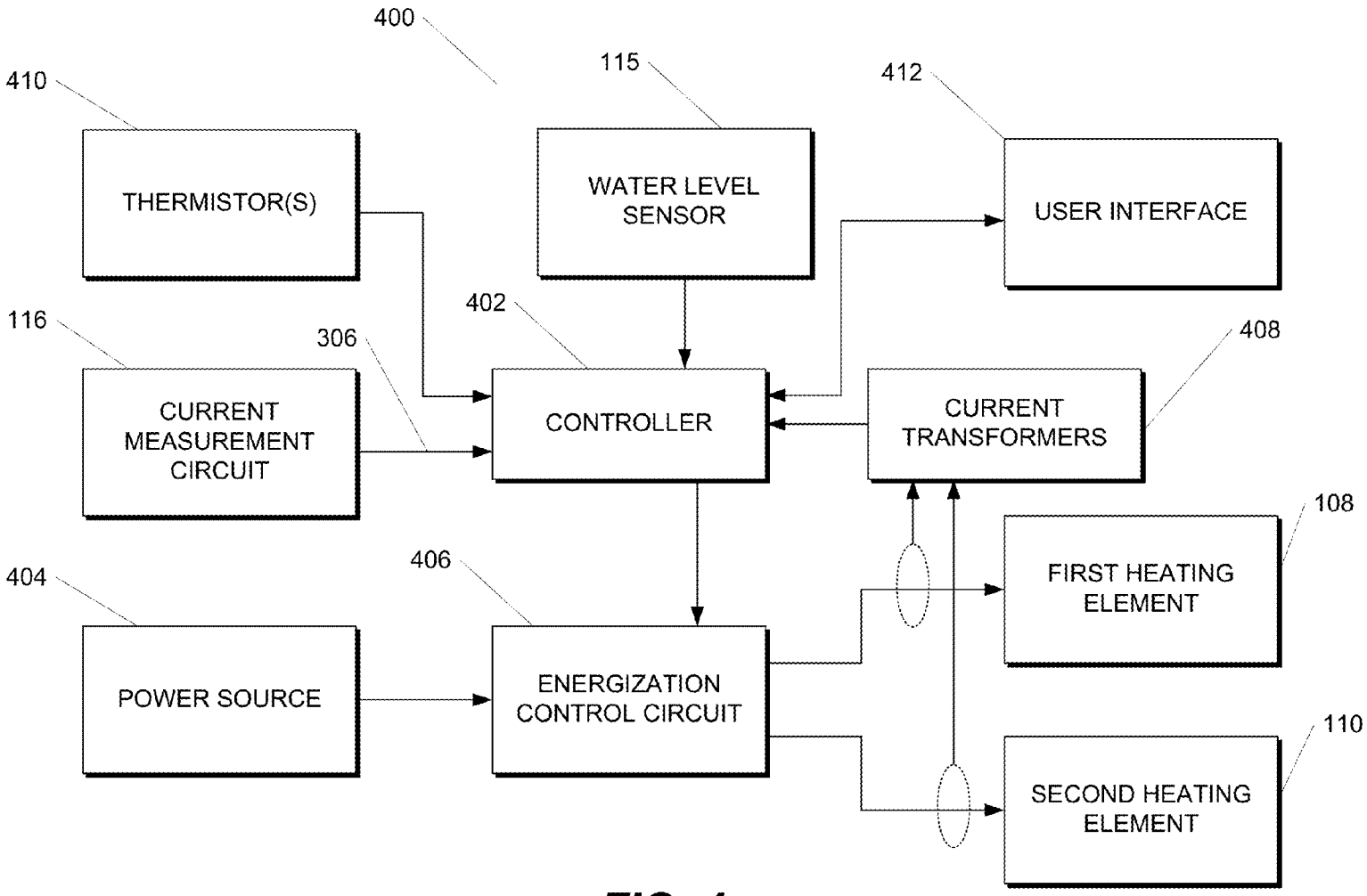
FIG. 4 depicts an exemplary water heater control system according to an exemplary embodiment of the present disclosure.

FIG. 4 depicts an exemplary water heater control system 400 according to an exemplary embodiment of the present disclosure. In particular, control system 400 can include a controller 402.

Controller 402 can be any suitable computing device and can include one or more processors, a memory, or other suitable components. In particular, the memory can store computer-readable instructions that are executed by the processor in order to perform one or more algorithms. In some implementations, controller 402 is an application specific integrated circuit.

Controller 402 can control energization of a first heating element 108 and a second heating element 110 by providing control signals to an energization control circuit 406. In particular, based on the control signals from controller 402, energization control circuit can either respectively allow or disallow a power signal from power source 404 to first heating element 108 and/or second heating element 110. As an example, energization control circuit can modify an AC power signal provided by power source 404 in order to energize heating elements 108 and 110 using a DC power signal.

According to aspects of the present disclosure, controller 402 can also receive signals or other information from a current measurement circuit 116, one or more current transformers 408, one or more thermistors 410, and water level sensor 115. Controller 402 can control operations of the water heater based on such signals.

For example, current measurement circuit 116 can provide a feedback signal 306 to controller 402 that describes a galvanic current flowing from an anode rod to an electrical ground. As another example, thermistor 410 can provide a temperature signal describing a local temperature about thermistor 410.

As yet another example, current transformers 408 can provide a power draw signal describing an energization current drawn by either first heating element 108 or second heating element 110. For example, controller 402 can provide a control signal to energization control circuit 406 instructing energization control circuit 406 to energize first heating element 108. In response, energization control circuit can energize first heating element 108 using power from power source 404.

Thus, first heating element 108 can draw an energization current in order to generate heat to raise the temperature of the water. Current transformer 408 can monitor or measure such energization current and generate a power draw signal describing the energization current. Current transformer 408 can provide the power draw signal to controller 402.

Controller 402 can control energization of heating elements 108 and 110 based the signals received from current measurement circuit 116, thermistor 410, current transformers 408, and/or water level sensor 115. As an example, controller 402 can discontinue energization of first heating element 108 when first heating element 108 is energized and feedback signal 306 indicates that the galvanic current did not increase when first heating element 108 was initially energized.

As another example, controller 402 can discontinue energization of first heating element 108 when the temperature signal provided by thermistor 410 indicates that the local temperature is increasing and feedback signal 306 indicates that the galvanic current is not increasing. Such combination of signals can indicate the first heating element 108 is generating heat but is not safely submerged in water.

As yet another example, controller 402 can discontinue energization of first heating element 108 when the power draw signal provided by current transformer 408 indicates that first heating element 108 is drawing an energization current and feedback signal 306 indicates that the galvanic current is not increasing. Such combination of signals can indicate that the first heating element 108 is operating but is not safely submerged in water.

As another example, controller 402 can provide a heating element error indication when water level sensor 115 indicates that the tank is full of water and feedback signal 306 indicates that galvanic current did not increase when first heating element 108 was energized.

Controller 402 can also provide a plurality of indications or messages to a user interface 412. For example, user interface 412 can include a display. Controller 402 can send a message to user interface 412 for presentation on the display. User interface 412 can provide controller 402 with one or more user-entered commands.

Figure 5:
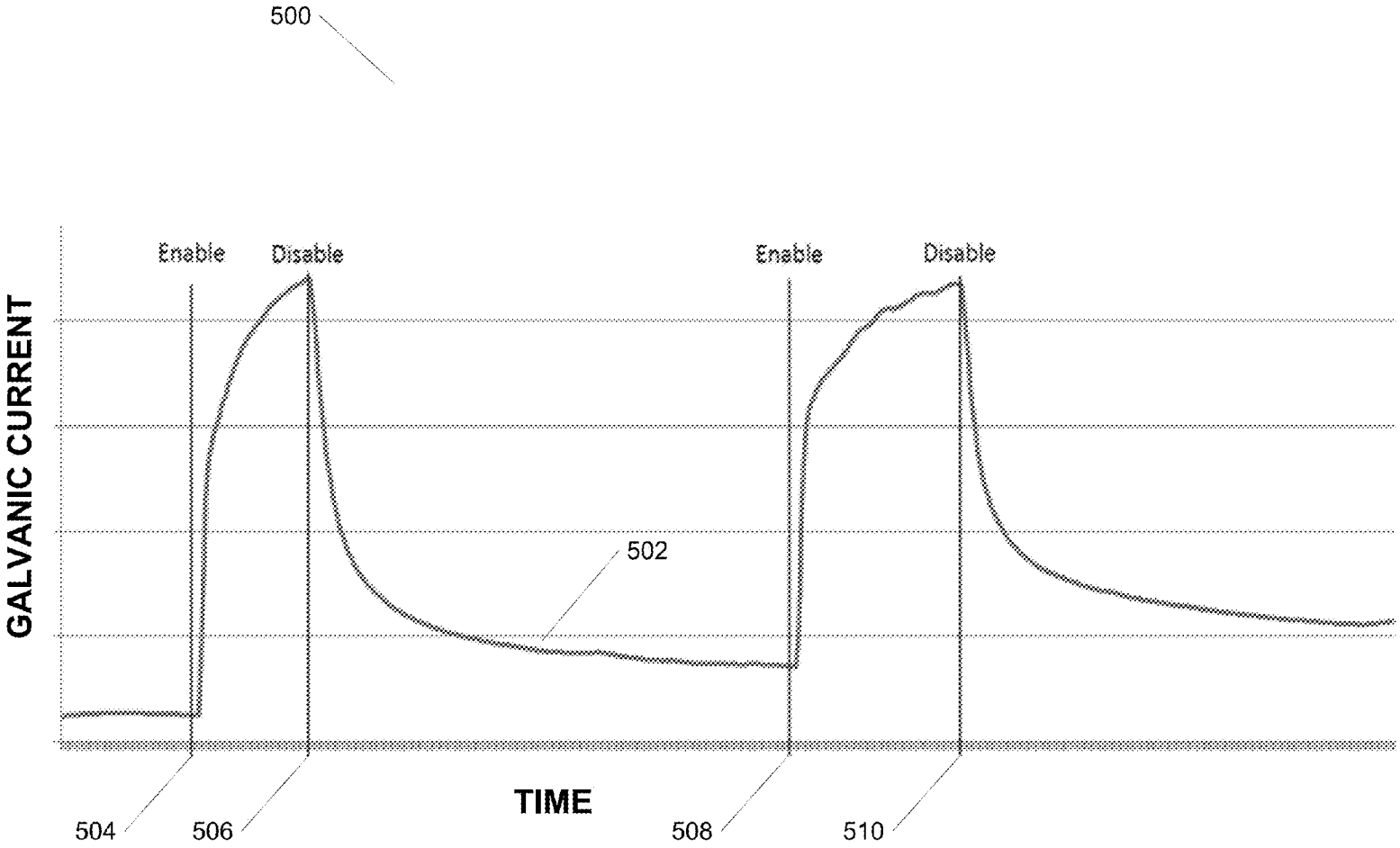
FIG. 5 depicts an exemplary graph of galvanic current versus time according to an exemplary embodiment of the present disclosure.

FIG. 5 depicts an exemplary graph 500 of galvanic current versus time according to an exemplary embodiment of the present disclosure. In particular, graph 500 depicts a plot 502 of galvanic current versus time. As will be discussed, plot 502 shows detectable changes in galvanic current when a heating element is energized.

At time 504 first heating element 108 of FIG. 1 is energized or otherwise enabled. At time 506, energization of first heating element 108 is discontinued. As can be seen from plot 502, energization of first heating element 108 caused a detectable change in galvanic current. In particular, energization of first heating element 108 resulted in a detectable increase in galvanic current.

At time 508 second heating element 110 of FIG. 1 is energized or otherwise enabled. At time 510, energization of second heating element 110 is discontinued. As can be seen from plot 502, energization of second heating element 110 caused a detectable change in galvanic current. In particular, energization of second heating element 110 resulted in a detectable increase in galvanic current.

Figure 6A:
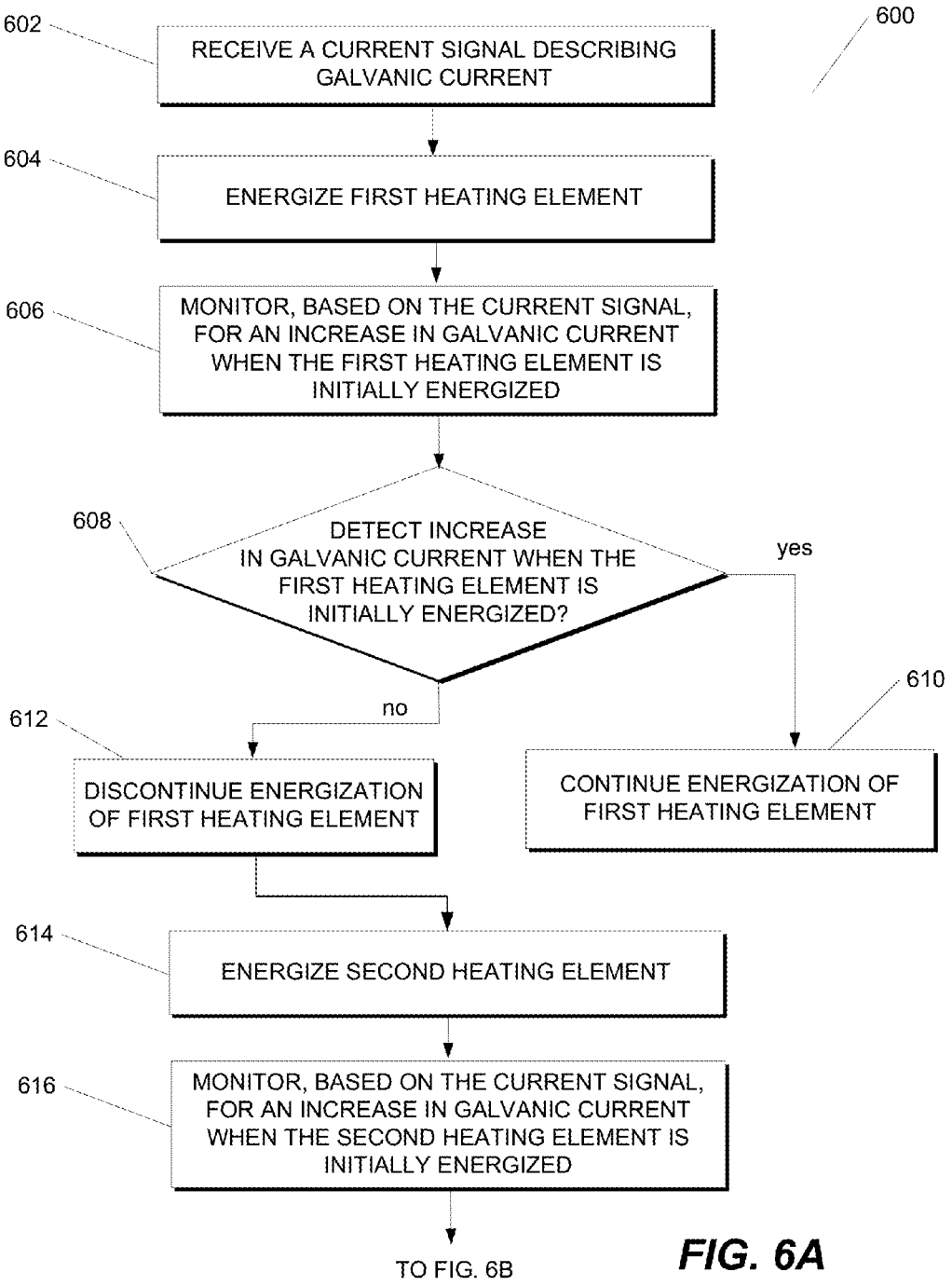
FIGS. 6A and 6B depict a flowchart of an exemplary method of operating a water heater according to an exemplary embodiment of the present disclosure.
Figure 6B:
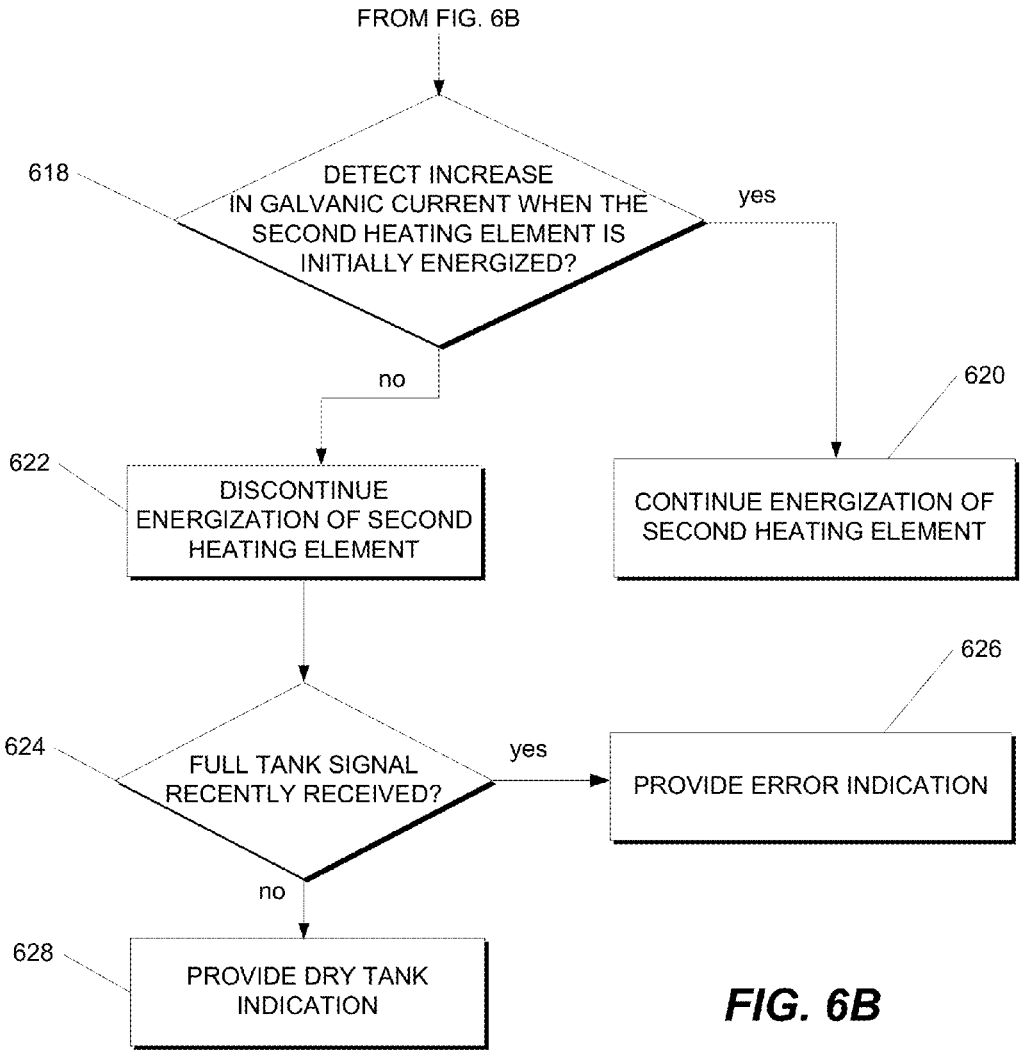

FIGS. 6A and 6B depict a flowchart of an exemplary method (600) of operating a water heater according to an exemplary embodiment of the present disclosure. While exemplary method (600) will be discussed with reference to exemplary water heating system 100 of FIG. 1 and exemplary control system 400 of FIG. 4, method (600) can be implemented using any suitable water heater control system. In addition, although FIGS. 6A and 6B depict steps performed in a particular order for purposes of illustration and discussion, methods of the present disclosure are not limited to such particular order or arrangement. One skilled in the art, using the disclosures provided herein, will appreciate that various steps of the method (600) can be omitted, rearranged, combined, and/or adapted in various ways without deviating from the scope of the present disclosure.

Referring now to FIG. 6A, at (602) a feedback signal describing a galvanic current can be received. For example, controller 402 can receive feedback signal 306 from current measurement circuit 116. Feedback signal 306 can describe a galvanic current flowing from anode rod 104 to electrical ground 118 of FIG. 1.

At (604) a first heating element can be energized. For example, controller 402 can send a control signal to energization control circuit 406. In response, energization control circuit 406 can energize first heating element 108.

Based on the feedback signal received at (602), an increase in galvanic current can be monitored for at (606) when the first heating element is initially energized at (604). For example, controller 402 can analyze feedback signal 306 to monitor for an increase in galvanic current when first heating element 108 is initially energized.

Controller 402 can monitor for an increase in galvanic current by periodically sampling feedback signal 306. For example, controller 402 can calculate, for each sample with respect to the previous sample, a change in value of feedback signal 306. Controller 402 can monitor for a change in value that indicates an increase in value greater than a threshold increase. An increase in feedback signal value greater than the threshold increase can indicate that first heating element 108 is submerged in water and properly operating.

As another example, controller 402 can calculate, for each sample with respect to the previous sample, a percent increase in feedback signal 306. Controller 402 can monitor for a percent increase greater than a threshold percentage. A percent increase in feedback signal 306 greater than the threshold percentage can indicate that first heating element 108 is submerged in water and properly operating.

At (608) it is determined whether an increase in galvanic current was detected at (606). If it is determined that an increase in galvanic current was detected at (606), then it can be assumed that the first heating element is submerged in water and operating properly. Therefore, energization of the first heating element can be safely continued at (610).

However, if it is determined at (608) that an increase in galvanic current was not detected at (606), then it can be assumed that either the first heating element is not operating properly or is not submerged in water and is therefore susceptible to the dangers of a dry tank. Therefore, energization of the first heating element can be discontinued at (612) in order to avoid potential dry tank dangers. For example, controller 402 can send a control signal to energization control circuit 406 to discontinue energization of first heating element 108.

At (614) a second heating element can be energized. For example, controller 402 can send a control signal to energization control circuit 406. In response, energization control circuit 406 can energize second heating element 110. More particularly, as shown in FIG. 1, second heating element 110 can be positioned within thank 102 at a lower height than first heating element 108. Thus, although first heating element 108 may not be submerged and therefore susceptible to dry tank dangers, second heating element 110 may still be safely submerged in water.

Based on the feedback signal received at (602), an increase in galvanic current can be monitored for at (616) when the second heating element is initially energized at (614). For example, controller 402 can analyze feedback signal 306 to monitor for an increase in galvanic current when second heating element 110 is initially energized.

Referring now to FIG. 6B, at (618) it is determined whether an increase in galvanic current was detected at (616). If it is determined that an increase in galvanic current was detected at (616), then it can be assumed that the second heating element is submerged in water and operating properly. Therefore, energization of the second heating element can be safely continued at (620).

However, if it is determined at (618) that an increase in galvanic current was not detected at (616), then it can be assumed that either the second heating element is not operating properly or is not submerged in water and is therefore susceptible to the dangers of a dry tank. Therefore, energization of the second heating element can be discontinued at (622) in order to avoid potential dry tank dangers. For example, controller 402 can send a control signal to energization control circuit 406 to discontinue energization of second heating element 110.

At (624) it is determined whether a full tank signal has recently been received. For example, water level sensor 115 can provide controller 402 with an indication that tank 102 is full of water.

If it is determined at (624) that a full tank signal has recently been received then one or more error indications can be provided at (626). In particular, if a full tank indication has been received but an increase in galvanic current is not detected when either the first or second heating elements are energized, then one or more components of the water heating system are not working properly.

For example, the water level sensor may be providing an incorrect signal that the tank is full of water. As another example, one or both of the first and second heating elements may not properly be receiving or dissipating an energization current. As yet another example, the galvanic current feedback system could be malfunctioning.

Controller 402 can provide one or more error indications to user interface 412 which notify the user that an error has occurred. Alternatively or in addition, controller 402 can provide the one or more error indications to other internal components of the water heater or via a network interface to a utility provider or other entity.

If it is determined at (624) that a full tank signal has not recently been received, then the most appropriate conclusion is that neither the first nor the second heating elements are safely submerged in water. Therefore, at (628) a dry tank indication can be provided. For example, controller 402 can provide a dry tank indication to user interface 412, other internal water heater components, or to a remote entity by way of a network connection.

One of skill in the art will appreciate that additional steps analogous to steps (624)-(628) can be performed in between steps (612) and (614) of method (600) or directly after step (620). More particularly, a determination can be made as to whether first heating element 108 is malfunctioning or experiencing a dry tank even if energization of second heating element 110 properly registers an increase in galvanic current.

Figure 7:
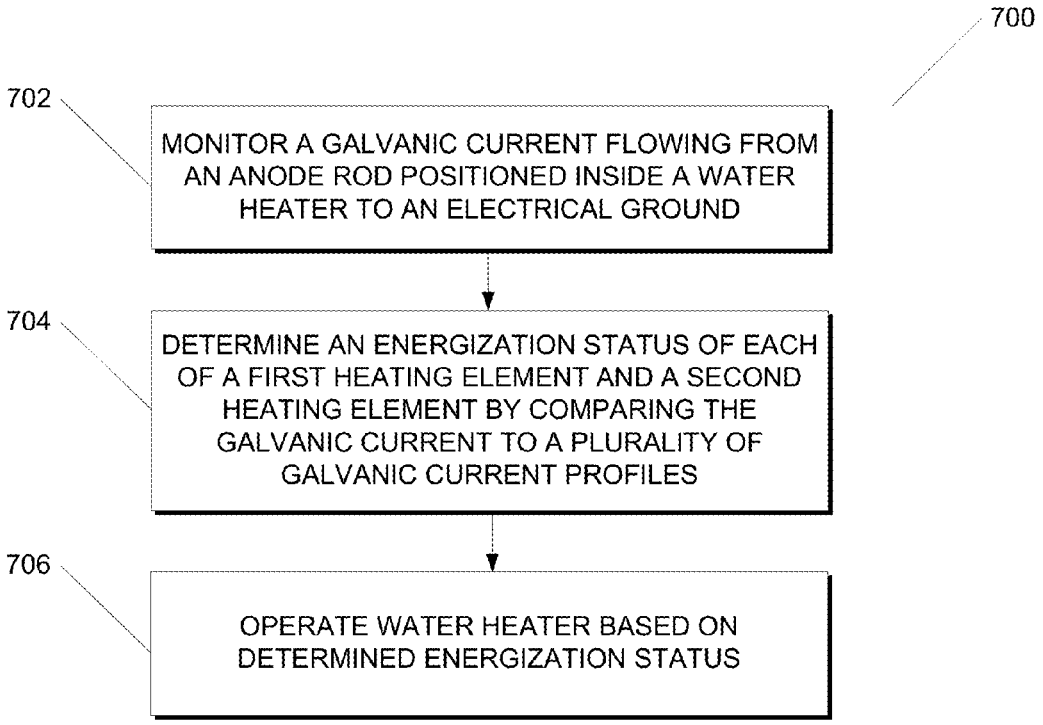
FIG. 7 depicts a flowchart of an exemplary method of operating a water heater according to an exemplary embodiment of the present disclosure.

FIG. 7 depicts a flowchart of an exemplary method (700) of operating a water heater according to an exemplary embodiment of the present disclosure. While exemplary method (700) will be discussed with reference to exemplary water heating system 100 of FIG. 1 and exemplary control system 400 of FIG. 4, method (700) can be implemented using any suitable water heater control system. In addition, although FIG. 7 depicts steps performed in a particular order for purposes of illustration and discussion, methods of the present disclosure are not limited to such particular order or arrangement. One skilled in the art, using the disclosures provided herein, will appreciate that various steps of the method (700) can be omitted, rearranged, combined, and/or adapted in various ways without deviating from the scope of the present disclosure.

At (702) a galvanic current flowing from an anode rod positioned inside a water heater to an electrical ground can be monitored. For example, current measurement circuit 116 can monitor the galvanic current flowing from anode rod 104 to electrical ground 118. Current measurement circuit 116 can generate a feedback signal 306 that describes the galvanic current. Current measurement circuit 116 can provide feedback signal 306 to controller 402. As an example, controller 402 can monitor the galvanic current by periodically analyzing a plurality of samples of feedback signal 306.

At (704) an energization status of each of a first heating element and a second heating element can be determined by comparing the galvanic current to a plurality of galvanic current profiles. For example, as can be seen from FIG. 5, energization of either first heating element 108 or second heating element 110 can result in a distinct change in behavior or characteristics of galvanic current. Simultaneous energization of both first heating element 108 and second heating element 110 can result in another distinct change in behavior or characteristics of the galvanic current.

Therefore, a galvanic current profile can be determined which describes the particular change in behavior or characteristics of the galvanic current upon the energization of first heating element 108, second heating element 110, both first heating element 108 and second heating element 110, or neither first heating element 108 nor second heating element 110. Thus, the prevailing behavior or characteristics of the galvanic current can be compared with the plurality of galvanic current profiles to determine an energization status of each of first heating element 108 and first heating element 110.

As the electrical properties of the water stored in the tank and/or the electrical properties of the anode rod can change over time, the plurality of galvanic current profiles can be stored in memory and then updated or revised according to a calibration algorithm.

At (706) the water heater is operated based at least in part on the energization statuses determined at (704). For example, energization of either or both of the first or second heating elements can be initiated or discontinued based upon the energization statuses determined at (704). As another example, an error indication or a dry tank indication can be provided.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a water heater, the method comprising:

receiving a feedback signal describing a galvanic current flowing from an anode rod included in the water heater to an electrical ground;

energizing a first heating element, the first heating element being configured to heat a volume of water stored in the water heater when energized;

monitoring, based on the feedback signal, for an increase in galvanic current when the first heating element is energized; and heating the volume of water using only a second heating element when an increase in galvanic current is not detected when the first heating element was energized, the second heating element being located at a lower height within the water heater than the first heating element.

2. The method of claim 1, further comprising discontinuing energization of the first heating element when an increase in galvanic current is not detected when the first heating element was energized.

3. The method of claim 1, further comprising continuing energization of the first heating element when an increase in galvanic current is detected when the first heating element was energized.

4. The method of claim 1, further comprising providing a dry tank indication when an increase in galvanic current is not detected when the first heating element was energized.

5. The method of claim 1, further comprising:

receiving a full tank signal indicating that the water heater is generally filled with water; and providing a heating element error indication when the full tank signal has been received and an increase in galvanic current is not detected when the first heating element was energized.

6. The method of claim 1, wherein monitoring, based on the feedback signal, for an increase in galvanic current when the first heating element is energized comprises:

periodically sampling the feedback signal;

calculating, for each sample with respect to the previous sample; a percent increase; and monitoring, when the first heating element is energized, for a percent increase greater than a threshold percentage.

7. The method of claim 1, wherein monitoring, based on the feedback signal, for an increase in galvanic current when the first heating element is energized comprises:

periodically sampling the feedback signal;

calculating, for each sample with respect to the previous sample, a change in value of the feedback signal; and monitoring, when the first heating element is energized, for a change in value indicating an increase in value greater than a threshold increase.

8. The method of claim 1, further comprising:

energizing the second heating element, the second heating element being configured to heat the volume of water stored in the water heater when energized;

monitoring, based on the feedback signal, for an increase in galvanic current when the second heating element is energized; and determining a water level in the water heater based on whether an increase in galvanic current was detected when the first heating element was energized and whether an increase in galvanic current was detected when the second heating element was energized.

9. The method of claim 1, further comprising:

receiving a temperature signal describing a temperature adjacent to the first heating element; and discontinuing energization of the first heating element when the temperature signal indicates that the temperature is increasing and an increase in galvanic current was not detected when the first heating element was energized.

10. A method of operating a water heater having a first heating element and a second heating element, the method comprising:

monitoring a galvanic current flowing from an anode rod positioned inside the water heater to an electrical ground; and determining an energization status of each of the first heating element and the second heating element by comparing the galvanic current to a plurality of galvanic current profiles, the plurality of galvanic current profiles comprising:

a first galvanic current profile describing the behavior of the galvanic current when the neither the first heating element nor the second heating element are energized;

a second galvanic current profile describing the behavior of the galvanic current when the first heating element is energized and the second heating element is not energized;

a third galvanic current profile describing the behavior of the galvanic current when the second heating element is energized and the first heating element is not energized;

a fourth galvanic current profile describing the behavior of the galvanic current when both the first heating element and the second heating element are energized.

11. The method of claim 10, further comprising determining a water level in the water heater by comparing the galvanic current to the plurality of galvanic current profiles.

12. A method of operating a water heater, the method comprising:

receiving a feedback signal describing a galvanic current flowing from an anode rod included in the water heater to an electrical ground;

energizing a first heating element, the first heating element being configured to heat a volume of water stored in the water heater when energized;

monitoring, based on the feedback signal, for an increase in galvanic current when the first heating element is energized;

energizing a second heating element, the second heating element being configured to heat the volume of water stored in the water heater when energized, the second heating element being at a different height within the water heater than the first heating element;

monitoring, based on the feedback signal, for an increase in galvanic current when the second heating element is energized; and determining a water level in the water heater based on whether an increase in galvanic current was detected when the first heating element was energized and whether an increase in galvanic current was detected when the second heating element was energized.

13. The method of claim 12, further comprising discontinuing energization of the first heating element when an increase in galvanic current is not detected when the first heating element was energized.

14. The method of claim 12, further comprising continuing energization of the first heating element when an increase in galvanic current is detected when the first heating element was energized.

15. The method of claim 12, further comprising providing a dry tank indication when an increase in galvanic current is not detected when the first heating element was energized.

16. The method of claim 12, further comprising heating the volume of water using only the second heating element when an increase in galvanic current is not detected when the first heating element was energized, the second heating element being located at a lower height within the water heater than the first heating element.

17. The method of claim 12, further comprising:

receiving a full tank signal indicating that the water heater is generally filled with water; and providing a heating element error indication when the full tank signal has been received and an increase in galvanic current is not detected when the first heating element was energized.

18. The method of claim 12, wherein monitoring, based on the feedback signal, for an increase in galvanic current when the first heating element is energized comprises:

periodically sampling the feedback signal;

calculating, for each sample with respect to the previous sample, a percent increase; and monitoring, when the first heating element is energized, for a percent increase greater than a threshold percentage.

19. The method of claim 12, wherein monitoring, based on the feedback signal, for an increase in galvanic current when the first heating element is energized comprises:

periodically sampling the feedback signal;

calculating, for each sample with respect to the previous sample, a change in value of the feedback signal; and monitoring, when the first heating element is energized, for a change in value indicating an increase in value greater than a threshold increase.

20. The method of claim 12, further comprising:

receiving a temperature signal describing a temperature adjacent to the first heating element; and discontinuing energization of the first heating element when the temperature signal indicates that the temperature is increasing and an increase in galvanic current was not detected when the first heating element was energized.

* * * * *